United States Patent [19]

Bolliger

[11] Patent Number: 4,657,240

[45] Date of Patent: Apr. 14, 1987

[54] DEVICE FOR LATERAL ALIGNMENT OF FLAT OBJECTS IN A FLOW

[75] Inventor: Edwin Bolliger, Morges, Switzerland

[73] Assignee: Bobst SA, Switzerland

[21] Appl. No.: 795,260

[22] Filed: Nov. 5, 1985

[30] Foreign Application Priority Data

Nov. 5, 1984 [CH] Switzerland ..... 05302/84

[51] Int. Cl.[4] ..... B65H 9/10

[52] U.S. Cl. ..... 271/250; 271/253

[58] Field of Search ..... 271/253, 240, 248, 250, 271/249, 252, 254, 255, 238, 84, 271, 269

[56] References Cited

U.S. PATENT DOCUMENTS

| | | | |
|---|---|---|---|
| 2,565,054 | 8/1951 | Watrous | 271/236 |
| 3,593,989 | 7/1971 | Crittenden | 271/263 |
| 3,854,315 | 12/1974 | Winkler | 271/250 |
| 4,092,022 | 5/1978 | Preuss et al. | 271/236 |

FOREIGN PATENT DOCUMENTS

| | | |
|---|---|---|
| 351307 | 6/1931 | United Kingdom . |
| 723376 | 2/1955 | United Kingdom . |
| 786395 | 11/1957 | United Kingdom . |
| 1033727 | 6/1966 | United Kingdom . |
| 1532617 | 11/1978 | United Kingdom . |

*Primary Examiner*—Andres Kashnikow

[57] ABSTRACT

An alignment device for alignment of cardboard and corrugated cardboard sheets as they enter a processing machine. The device includes a lateral alignment member which works strongly with a stop and includes a parallelogram arrangement for mounting a pushing member to move in a linear path to push a sheet against the stop. The stop is provided with a brush and a free-moving omni-directional roller to frictionally grip a blank as it is moved against the stop, the brush and roller are mounted on a movable lever. Movement of the lever as well as movement of the pushing member are both controlled by different cams which are set to have the desired alignment followed by a release of the blank occur in the desired sequence.

5 Claims, 5 Drawing Figures

DEVICE FOR LATERAL ALIGNMENT OF FLAT OBJECTS IN A FLOW

BACKGROUND OF THE INVENTION

The present invention is directed to a device for the lateral alignment of flat objects arranged in a flow, for example, the lateral alignment of sheets of corrugated cardboard being introduced into a feeder of a processing machine such as a die-cutter.

Several lateral alignment stations are well known. They operate preferably by aligning the sheets fed to a processing machine by moving one edge of the blank which is provided with registration marks against a stop. The alignment occurs either by pushing or drawing the sheet material. The alignment by pushing the material is used in processing of corrugated cardboard sheets while the alignment by drawing the material is usually used for processing sheets of plain but not too heavy cardboard. Corrugated cardboard can be coated with a printed sheet on one face. This printed sheet is glued onto the corrugations of the corrugated cardboard or onto one face of a double-faced corrugated cardboard sheet. In both cases, a laminated cardboard sheet is obtained. The printing of the laminated cardboard sheet occurs with positioning references for further processing of the sheet. The alignment means are set with regard to these registration marks.

Nevertheless, the existing alignment devices, particularly those pushing the laminated corrugated cardboard sheets, cannot insure sufficient accuracy with high speed processing. For example, the pushing hits the sheet with too much force and causes the sheet to easily lose its correct positioning because of bouncing or movement against the stop. In addition, the alignment member might damage the cardboard sheet. For example, if one ply of the laminated sheet extends past the edges of the other plies, the production becomes worthless because the references will be destroyed.

SUMMARY OF THE INVENTION

The present invention is directed to an aligning device which insures good processing operations at high speeds and at reasonable costs. To accomplish these goals, the present invention is directed to a device for laterally aligning the flow of flat objects against a fixed stop. The device comprises a frame, a stop with means mounting the stop on one end of the frame, lateral alignment means being disposed on the frame opposite the stop to urge the blanks against the stop, said lateral alignment means including a pushing member having a V-shaped groove extending along the direction of flow of blanks through the device, means mounting the pushing member for reciprocating movement and means for controllably shifting the pushing member towards the stop, said means for mounting the stop enabling movement between the stop and frame, means for monitoring the thickness of a blank flowing through the device and means for frictionally holding a flat object moved against the stop by the pushing member.

In particular, the means for shifting or moving the pushing member includes a mounting means to move the member along a path extending parallel to the plane of the blank, a spring means biasing the member towards the stop, a follower connected to the pushing member riding on a cam which controls the actual shifting as the cam is rotated. The means for mounting the stop for movement on the frame includes a lever arm mounted for rotation to move the stop through an arc, said lever arm having a follower engaging a second cam. The means for frictionally engaging is also mounted on the lever arm and includes a brush for frictionally engaging a surface of an object moved against a surface of the stop and a omni-directional roller mounted on the lever for rotation and engaging a surface of the blank as it moves by and towards the stop.

Other objects and advantages of the present invention will be apparent from the following drawings and description.

DESCRIPTION OF THE PREFERRED EMBODIMENTS

Figure 1:
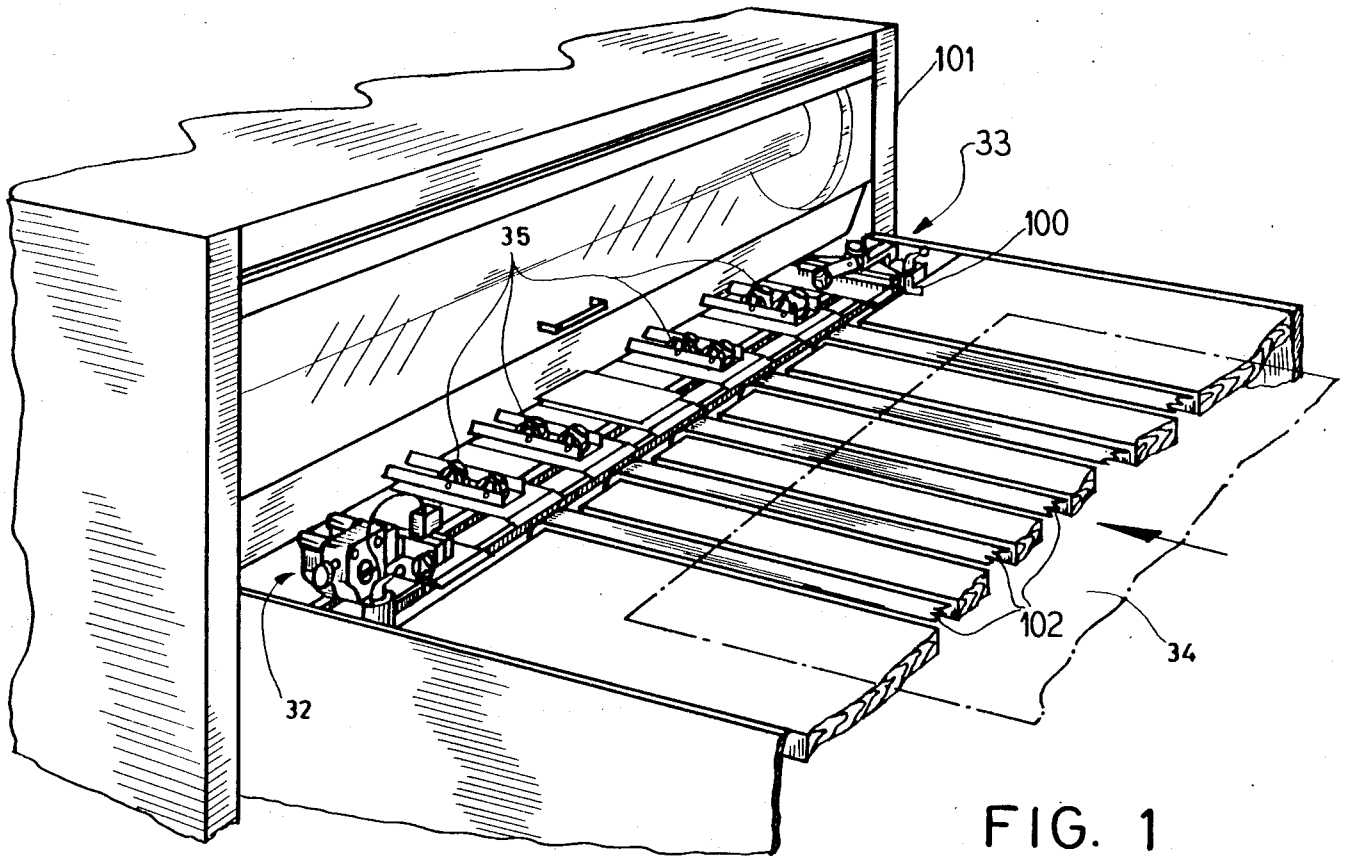
FIG. 1 is a perspective view of the lateral alignment device of the present invention being imposed with a processing device.

The principles of the present invention are particularly useful in a device 100 for laterally aligning a flow of objects such as sheets 34 being introduced into a processing device such as a die-cutter generally indicated at 101 in FIG. 1. The device 100 includes lateral alignment means generally indicated at 32 at one end and a stop arrangement generally indicated at 33 at the opposite end. As illustrated, a sheet 34 of corrugated cardboard is being transported by conveyor belts 102 into the processing device 101 and the device includes a plurality of omni-directional rolling means 35 to maintain the sheet in a substantially flat configuration as it passes through the device 100 for alignment.

Figure 2:
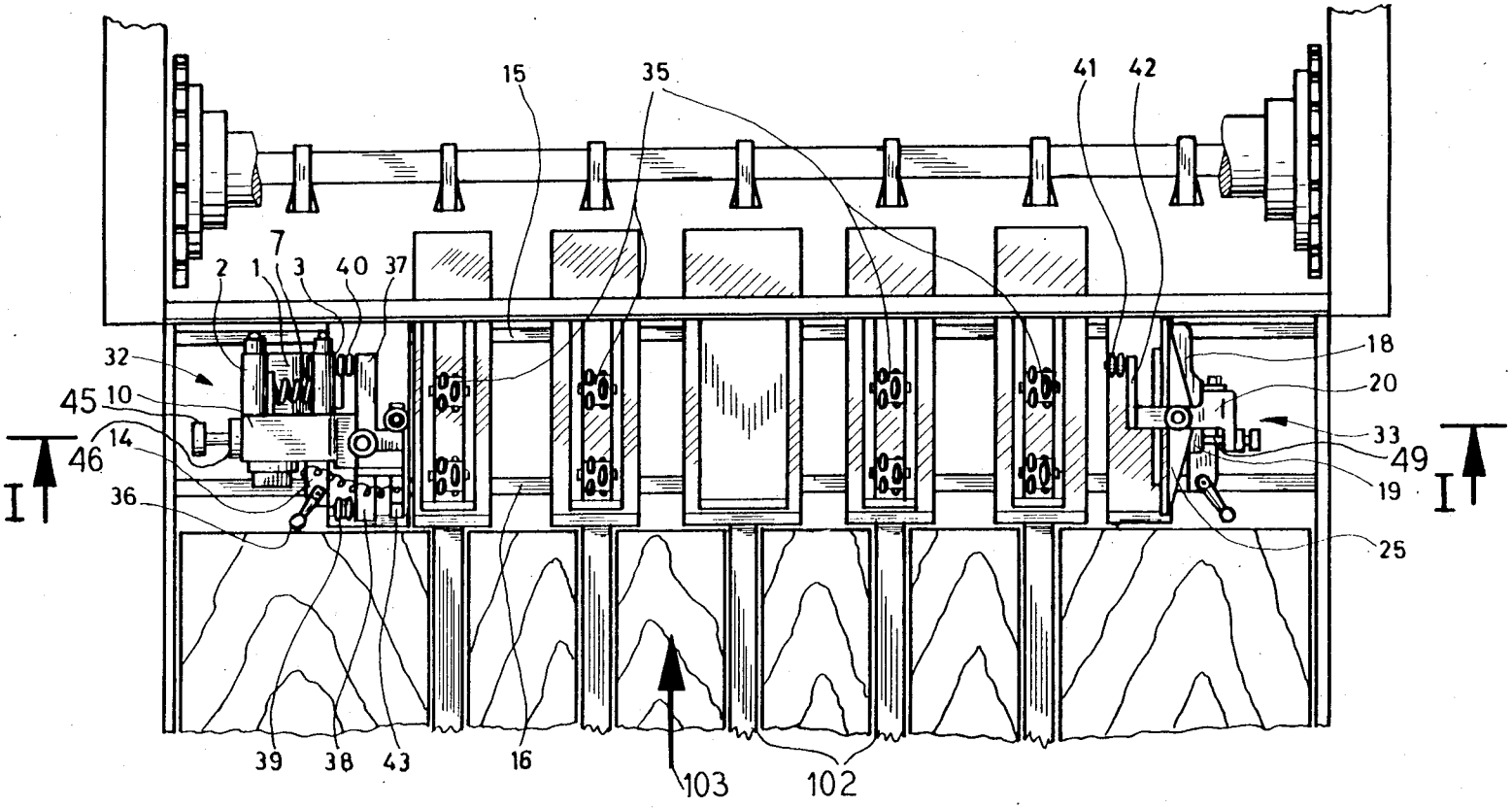
FIG. 2 is a plan top view of the device of the present invention.
Figure 3:
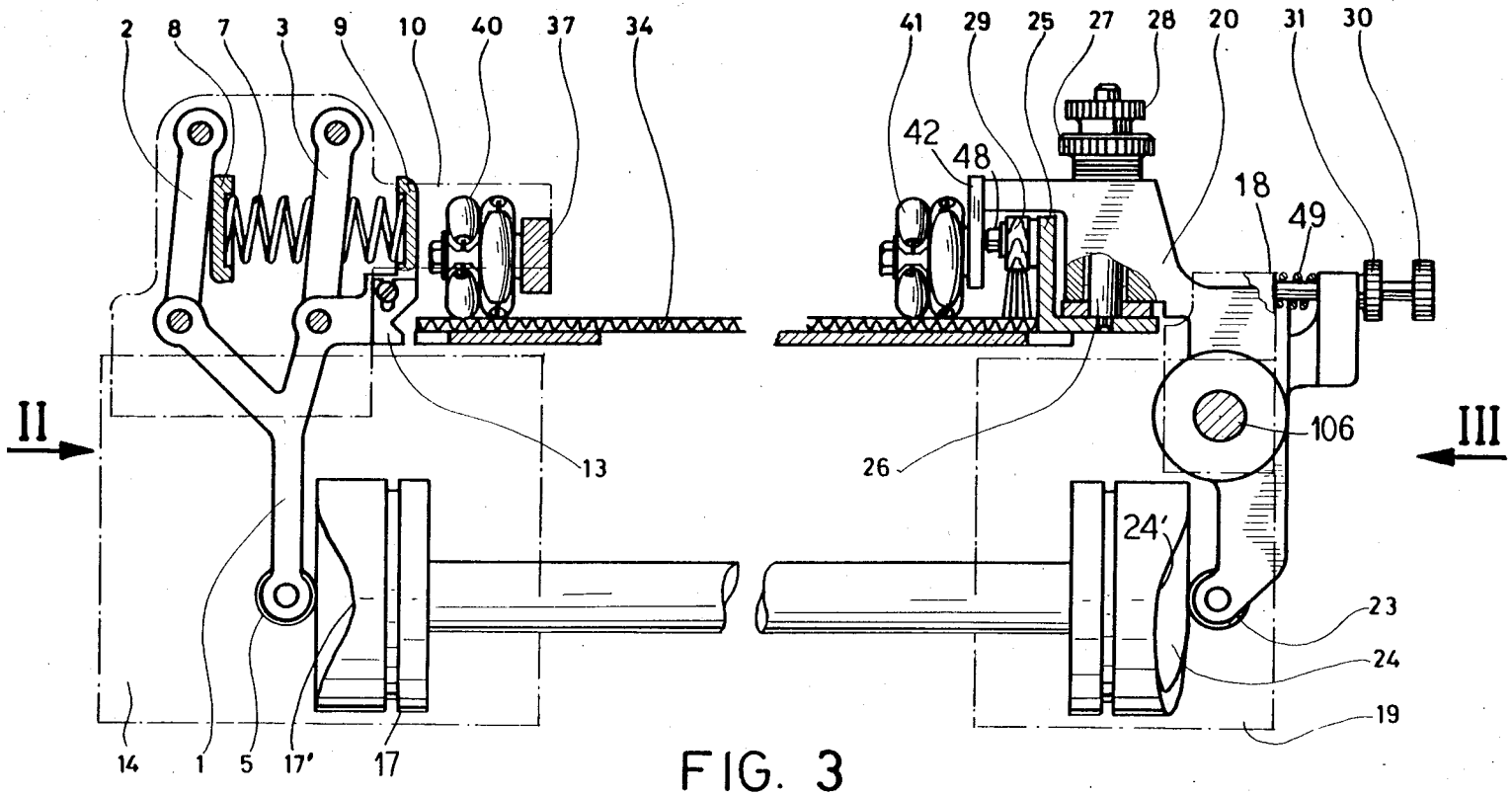
FIG. 3 is a cross-sectional view taken along lines I—I of FIG. 2 with portions in elevation for purposes of illustration.

As best illustrated in FIG. 2, the device includes a frame having two crossbars or rails 15 and 16 that extend transverse to the direction of movement indicated by the arrow 103 in FIG. 2. The lateral alignment means or member 32 includes one support 10 mounted on a carriage 14 which is tightened on the crossbars 15 and 16 by a screw 36. Two rod members 2 and 3 are mounted for pivotal movement on the support 10. A lever 1, which is best illustrated in FIG. 3, has a Y configuration and is pivotally connected to the rod members or arms 2 and 3. In addition, a spring 7 as well as two arms 37 and 38 are arranged on the support 10. The arm 37 is provided with a free-moving omni-directional roller 40 while the arm 38 has a free-moving omni-directional roller 39. The pressure on the omni-directional rollers 39 and 40 can be set and the support 10 also includes means for monitoring the thickness of a blank flowing through the device which as illustrated includes a microswitch 43 which is positioned adjacent the lever 38.

The stop 33 has a profile or flat member 25, which is mounted on a lever 20 which is pivotally mounted on a support 18. The support 18 is secured on a carriage 19. A free-moving omni-directional roller 41 is mounted on a plate 42 which is connected with the lever 20.

In addition, it should be noted that the device of the present invention is provided on a conveyor which is composed of a plurality of belts such as 102 (FIG. 2) which moves the blank such as 34 into the device 101 which as mentioned could be a processing device such as a die-cutter.

The arrangement of the Y-shaped lever 1 and the rod members or arms 2 or 3 is best illustrated in FIG. 3. As illustrated, one leg of the Y-shaped lever 1 carries a cam follower or roller 5 which rides on a cam surface of a cylindrical cam 17. The lever arm 1 is pivotally connected to the two members 2 and 3 which in turn are mounted for pivotal movement on the support 10. The distance between the pivotal connecting of the arms 2 and 3 to the support 10 and the connection to the Y-shaped member 1 are the same to form a parallelogram arrangement. One end of the spring 7 acts against a plate 8, which is connected to the support 10, and the other end bears against a plate 9 which is connected to one of the arms or legs of the lever 1 which supports an elongated pushing member 13 that has a horizontally extending groove that extends in the direction of movement of the blanks such as 34.

The cam 17 is a cylindrical cam and has an annularly extending cam surface which is engaged by the follower 5. A majority of the cam surface is in a position to hold the edge or the pushing member 13 out of engagement with an edge of the blank 34. However, when the cam member moves into a low spot 17', the spring 7 urges the member 13 into engagement with the edge of the blank 34 to shove it laterally so that its opposite edge engages the planar stop plate or member 25. The spring acts on the parallelogram arrangement to change its shape and to move the member 13 in a linear path parallel to the plane of the sheet 34.

The stop arrangement as mentioned before includes the stop plate or member 25 on which a brush 29 is mounted by screws or bolts 48. The stop plate 25 has a threaded member or axle 26 secured thereto and the axle extends through the lever 20, which has an angle shape, and is tightened by milled nuts such as 27 and 28. A setting screw 30 having a lock nut 31 can engage a portion of a support 18 shown in broken lines. As illustrated, a spring 49 is received on the setting screw 30 and acts to shift the lever 20 in a clockwise direction around its pivotal mounting 106 which will be discussed in greater detail with regard to FIG. 5. A lower end of the lever 20 carries a roller or cam follower 23 which rides on the cam surface of a cam 24.

Figure 4:
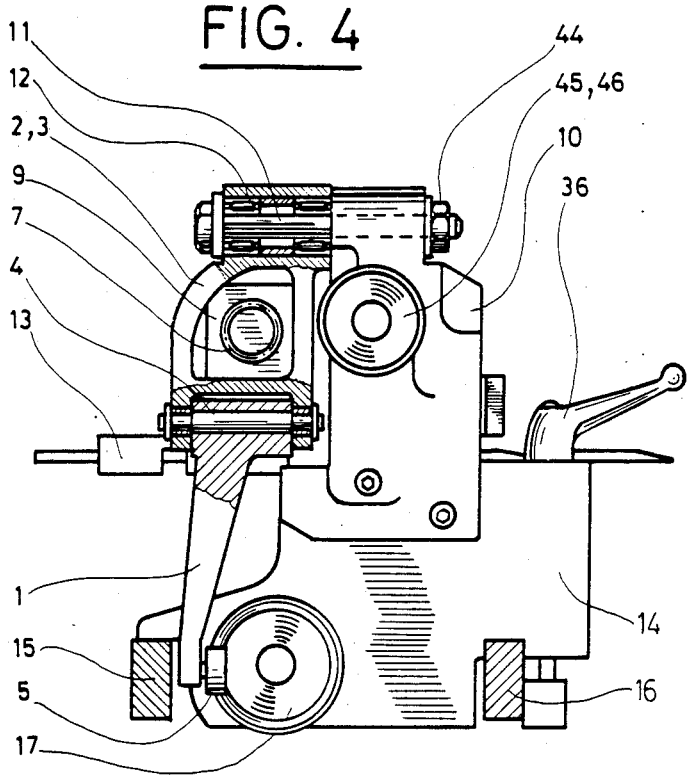
FIG. 4 is an end view taken in the direction of arrow II of FIG. 3.

As illustrated in FIG. 4, the carriage 14 slides on the rails or crossbars 15 and 16 and will be locked in the desired position by rotating the handle 36 which tightens the screw. The support 10 pivotally supports each of the rods 2 and 3. This is accomplished by a pivotal mounting including a bolt 11 which supports the inner races of two bearings 12. The bolt 11 extends through the support 10 and is secured in its fixed position by a nut 44. The outer races of the bearings 12 are received in a bore in the respective rod member or arms 2 or 3 and separated by a spacer.

The pivotal connection between the legs of the Y-shaped member 1 and each of the arms 2 and 3 is formed by a bolt or axle 4 which extends through each of the legs and is mounted at the end of each of the two arms 2 and 3. As mentioned, the spring 7 acting between a plate 9 connected to the lever 1 and a plate 8 connected to the support 10 presses the follower 5 of the Y-shaped member 1 against the cam surface of the cam 17. The tension of the spring 7 can be adjusted through a setting screw 45 which is mounted in the support and is provided with a lock nut 46 which is best illustrated in FIG. 2.

Figure 5:
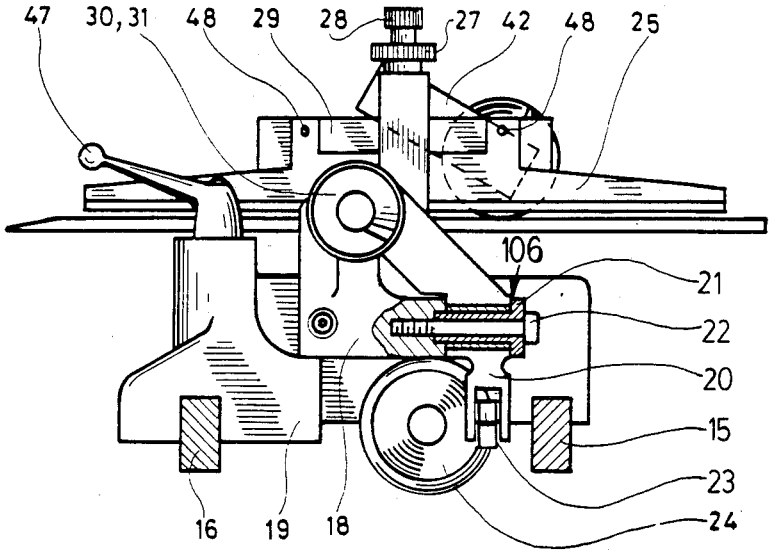
FIG. 5 is an end view of the device taken in the direction of arrow III of FIG. 3.

As best illustrated in FIG. 5, the stop 33 has the carriage 19 which is movable on the rails or crossbars 15 and 16 and in locked in a desired position by a threaded locking arrangement 47. The support 18 is mounted on the carriage 19 and forms a pivotal mounting 106 for the lever 20. As illustrated, the pivotal mounting 106 includes a screw 22 extending through a collar socket 21 which is received in a bore of the lever 20. As mentioned, the maximum pivoting motion of the lever 20 in a counterclockwise direction is determined by the set screw 30 and the spring 49 urges the lever to be pivoted in a clockwise direction as illustrated in FIG. 3. The cam surface of the cam 24 is engaged by the cam follower or roller 23 mounted on the lower end of the lever 20 so that as the cam moves, a low portion 24' of the cam will allow the spring 49 to lift the stop or plate 25, the brush 29 and the omni-directional roller 41 out of the position illustrated in FIG. 3.

The device 100 operates in the following manner. As the sheet 34 is being introduced into the processing device 101, the cams 17 and 24 are positioned so that the flat surfaces are engaged by their respective followers 5 and 23 to position the alignment means 32 and the stop arrangement 33 in the positions illustrated in FIG. 3. When the follower 5 goes into the low portion 17' of the cam 17, the spring 7 urges the pushing member or bar 13 against an edge of the blank 34 to force the opposite edge against the stop member 25. The presence of the brush 29 and the omni-directional roller 41 cause a frictional engagement of the edge adjacent the stop 25 and prevent bouncing and/or other mispositioning. As the blank is continually transported toward the processing device and is about ready to be gripped therein, the cam 24 has moved to present the low portion 24' so that the lever 20 is rotated in a clockwise direction due to the force of the spring 49 to release the holding pressure created by the brush 29 and roller 41 and to also move the stop member 25 out of the plane of the blank. In this arrangement, it is noted that the alignment device 100 of the present invention does not offer any resistance to the gripper arrangement which grips the leading edge of the blank at the processing machine 100. It should be noted that the cams 17 and 24 are positioned so that the desired operations of pushing the blank against the stop and moving the stop and the holding means out of engagement with the blank occur in the desired sequence.

Although various minor modifications may be suggested by those versed in the art, it should be understood that I wish to embody within the scope of the patent granted hereon, all such modifications as reasonably and properly come within the scope of my contribution to the art.

I claim:

1. A device for laterally aligning a flow of flat objects against a fixed stop comprising a frame; a stop; means mounting the stop on one end of the frame enabling movement between the stop and frame; lateral alignment means being disposed on the frame opposite the stop to urge a blank against the stop; means for monitoring the thickness of the blank flowing through the device; and means for frictionally holding a flat object moved against the stop by the pushing member; said lateral alignment means including a pushing member having a V-shaped groove extending along the direction of flow of the blank through the device, means for mounting the pushing member for reciprocating in a path directed toward the stop, and means for controllably shifting the pushing member toward said stop; said means for mounting the pushing member for reciprocating movement including a pair of arms mounted for pivotal movement on a support, the lower ends of said arms being pivotally connected to a Y-shaped member to form a parallelogram, and spring means acting on said parallelogram to modify the shape thereof; and said means for controllably shifting the pushing member including a cam having a cam surface with a depression and a cam follower mounted on the Y-shaped member engaging said cam surface so that the depression allows the parallelogram to be shifted to urge the pushing member against an edge of a blank.

2. A device according to claim 1, wherein the means for mounting the stop includes a support, an angle-shaped member mounted for pivotal movement on said support, said angle-shaped member at one end supporting a stop member and the means for frictionally holding a flat object moved against the stop member, a second cam having a second cam surface, a received cam follower mounted on the angle-shaped lever engaging the second cam surface, said second cam surface having a depression allowing pivotal movement of the angle-shaped arm to move the stop and means for frictionally holding out of engagement with a blank.

3. A device according to claim 2, which includes spring means biasing the second cam follower of the angled lever against the second cam surface.

4. A device for laterally aligning a flow of flat objects comprising lateral alignment means, said lateral alignment means being composed of one movable member acting together with a stop including a support mounted on a shiftable carriage which is movable along two crossbars, a pair of rod members pivotally connected to said support in a spaced side-by-side arrangement, a Y-shaped lever having two arms connected to the lower ends of the rod member to form a parallelogram arrangement, said Y-shaped lever having a lower leg provided with a roller moving on a cam surface of a cylindrical cam, and a spring acting on said parallelogram arrangement to hold the roller on the cam surface, the rotation of said cam in conjunction with the spring causing the shape of the parallelogram arrangement to be changed, a bar being mounted on the parallelogram arrangement adjacent the Y-shaped lever and having a groove extending parallel to the direction of movement of a blank through the device to urge a blank against said stop, means for loosening the stop after the alignment operation, means for holding flat objects adjacent said stop, and means for monitoring the thickness of a blank flowing through the device.

5. A device according to claim 4, wherein the means for loosening the stop after the alignment operation includes a support mounted on a carriage shiftable on said crossbars, a angle-shaped lever pivotally mounted on said support, one end of said lever having a roller moving on a second cylindrical cam surface of a second cam, the other arm of said angle-shaped lever mounting the stop for adjustment thereon, a brush being mounted on the stop so that a low spot in the second cam surface allows the L-shaped lever to pivot to move the stop and brush out of engagement with a blank in the device.

* * * * *